US007165990B1

(12) United States Patent
Scholeno et al.

(10) Patent No.: US 7,165,990 B1
(45) Date of Patent: Jan. 23, 2007

(54) LAMP SOCKET WITH NOVEL WIRE CONNECTOR

(75) Inventors: Michael F. Scholeno, York, PA (US); Shane M. Brown, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/496,387

(22) Filed: Jul. 31, 2006

(51) Int. Cl.
*H01R 13/64* (2006.01)

(52) U.S. Cl. ..... 439/375; 439/226; 439/241

(58) Field of Classification Search ..... 439/375, 439/226, 239, 241, 699.2
See application file for complete search history.

(56) References Cited

U.S. PATENT DOCUMENTS 6,076,941 A * 6/2000 Hass et al. ..... 362/263
6,296,529 B1 * 10/2001 Tanigawa ..... 439/699.2
6,364,679 B1 * 4/2002 Gerstberger ..... 439/241
7,059,888 B1 6/2006 Frappier et al. ..... 439/226

* cited by examiner

*Primary Examiner*—Tho D. Ta
(74) *Attorney, Agent, or Firm*—William H. McNeill

(57) ABSTRACT

A wire connector (10) has an electrically insulating housing (12) with a bottom surface (14) for attachment to a base (16) and an upper surface (18) having a wire-receiving groove (20) formed therein. An electrical contact receiving position (22) is formed with the upper surface (18) adjacent the wire receiving groove (20) and an electrical contact (24) is fixed at the electrical contact receiving position (22). The electrical contact (24) has a tail (26) extending into the wire-receiving groove (20). A cover receiving position (28) is formed with the upper surface (18) and spaced from the electrical contact receiving position (22); and an electrically insulating cover (30) is fixed at the cover receiving position (28), the cover including a wire engaging portion (32) projecting into the wire receiving groove (20).

4 Claims, 1 Drawing Sheet

LAMP SOCKET WITH NOVEL WIRE CONNECTOR

TECHNICAL FIELD

This invention relates to lamp sockets and more particularly to high temperature lamp sockets. Still more particularly, it relates to such a socket that includes a new and useful wire attachment.

BACKGROUND ART

Double-ended metal halide arc discharge lamps are known. Some kinds of these lamps have achieved wide usage in entertainment lighting. One particular version of such a lamp is designated SharXS® and is produced by Osram Photo-Optic. Lamps of this type are available from Osram Sylvania Inc., Danvers, Mass. 01923. These lamps are provided in wattages from 200 to 1200 and operate at quite high temperatures. In fact, typical operating temperatures in area of the socket are in the range of 200 to 300° C. It is, of course, imperative that the sockets employed with these lamps also be able to operate for long periods of time at such temperatures and still maintain good electrical contact. One type of socket for double-ended lamps is shown and described in German Gebrauchmuster No. 295 04 517, filed Mar. 22, 1995. The socket utilizes a pair of spaced ceramic bodies containing electrical contacts in the form of a single spring that often results in poor contact resistance. To solve the latter problem a lamp socket has been supplied that provides supplemental springs. Such a socket is shown in pending U.S. patent application Ser. No. 10/930,664, filed Aug. 31, 2004, now, U.S. Pat. No. 7,059,888, and assigned to the assignee of the instant invention and, while it solves the poor contact resistance problem, makes the lamp somewhat difficult to remove from the socket because of the high frictional forces existing between the lamp contacts and the socket springs and because many fixtures have limited space, making it extremely difficult for an operator to get his or her hands into an appropriate position to remove an old lamp and insert a new one. The latter problem has been solved by the provision of a socket that contains a pivotable lever arm located adjacent the springs for removing the lamp and this solution is shown and described in pending U.S. patent application Ser. No. 11/397,043, filed Apr. 4, 2006 and assigned to the assignee of the present invention.

However, a problem still existed when it came to attaching the power-supplying wire to the electrical contacts.

DISCLOSURE OF INVENTION

It is, therefore, an object of the invention, to obviate the disadvantages of the prior art.

It is another object of the invention to enhance the operation of lamp sockets.

It is another object of the invention to enhance wire connections to lamp sockets.

These objects are accomplished, in one aspect of the invention, by the provision of a wire connector comprising: an electrically insulating housing having a bottom surface for attachment to a base and an upper surface, the upper surface having a wire receiving groove formed therein; an electrical contact receiving position formed with the upper surface adjacent the wire receiving groove; an electrical contact fixed at the electrical contact receiving position, the electrical contact having a tail extending into the wire receiving groove; a cover receiving position formed with the upper surface and spaced from the electrical contact receiving position; and an electrically insulating cover fixed at the cover receiving position, the cover including a wire engaging portion projecting into the wire receiving groove.

This connector provides a positive electrical connection for the wire and eliminates the necessity of forming a loop at the termination of the wire for attachment to a screw or other item.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
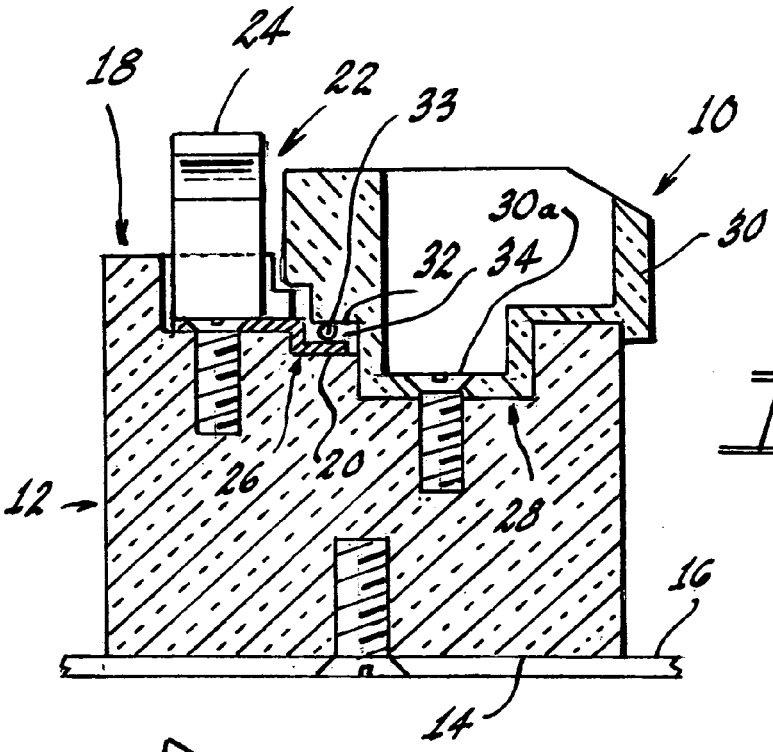
FIG. 1 is an elevational, sectional view of an embodiment of the invention.

Referring now to the drawings with greater particularity, there is shown in FIG. 1 a wire connector 10 comprising: an electrically insulating housing 12 formed of a suitable ceramic material, for example, steatite. The housing 12 has a bottom surface 14 for attachment to a base 16, as by bolt 16*a*, and an upper surface 18, the upper surface 18 having a wire receiving groove 20 formed therein. An electrical contact receiving position 22 is formed with the upper surface 18 adjacent the wire receiving groove 20; and an electrical contact 24 is fixed at the electrical contact receiving position 22, for example, by bolt 24*a*. The electrical contact 24 is substantially U-shaped having a tail 26 extending into the wire-receiving groove 20 and the bolt 24*a* is inserted through a bolt hole formed in the bight of the U-shaped contact. A cover receiving position 28 is formed the upper surface 18 and spaced from the electrical contact receiving position 22; and an electrically insulating cover 30 is fixed at the cover receiving position 28. The cover 30 is preferably formed from the same ceramic material as the housing, for example, the before mentioned steatite. The cover 30 includes a wire-engaging portion 32 projecting into the wire-receiving groove 20.

Thus, when the cover 30 is in position, a space 34 is defined between a surface of the tail 26 and the wire engaging portion 32, the space 34 having a given height, the given height being less than the diameter of a wire 33 to be inserted into the wire receiving groove 20.

Therefore, by inserting a wire 33 into the space 34 and then tightening the bolt 30*a*, the wire 33 is squeezed between the wire-engaging portion 32 and the tail 26 as the cover 30 is fixed to the housing 12. It is not necessary, nor desirable, to perform any other fixing solutions to the wire 33, other than stripping the insulation away from the part inserted.

Figure 2:
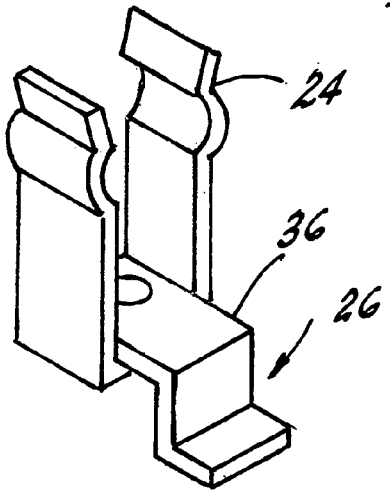
FIG. 2 is a perspective view of an alternate spring assembly for use with the invention.

While the most simple expedient for the electrical contact 24 is to form it and the tail 26 from the same material, if desired the tail 26 can be formed from a different element 36, as shown in FIG. 2. This situation would allow a selection between contact 24 materials that had superior spring-like capabilities and element 36 materials that had superior electrical capabilities.

There is thus provided a wire connector that enhances lamp sockets and more particularly enhances the wire connectability of lamp sockets.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A wire connector comprising:

an electrically insulating housing having a bottom surface for attachment to a base and an upper surface, said upper surface having a wire-receiving groove formed therein;

an electrical contact receiving position formed with said upper surface adjacent said wire receiving groove;

an electrical contact fixed at said electrical contact receiving position, said electrical contact having a tail extending into said wire receiving groove;

a cover receiving position formed with said upper surface and spaced from said electrical contact receiving position; and an electrically insulating cover fixed at said cover receiving position, said cover including a wire engaging portion projecting into said wire receiving groove.

2. The wire connector of claim 1 wherein, when said cover is in position, a space is defined between a surface of said tail and said wire engaging portion, said space having a given height, said given height being less than the diameter of a wire to be inserted into said wire receiving groove.

3. The wire connector of claim 1 wherein said electrical contact is substantially U-shaped.

4. The wire connector of claim 3 wherein said tail is formed from a separate element.

* * * * *